US009306314B2

(12) United States Patent
Wu et al.

(10) Patent No.: US 9,306,314 B2
(45) Date of Patent: Apr. 5, 2016

(54) CABLE CONNECTOR ASSEMBLY INSTALLED CONVENIENTLY AND METHOD OF ASSEMBLING THE SAME

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/668,008

(22) Filed: Mar. 25, 2015

(65) Prior Publication Data

US 2015/0280352 A1 Oct. 1, 2015

(30) Foreign Application Priority Data

Mar. 26, 2014 (CN) ..... 2014 1 0115402

(51) Int. Cl.

| | |
|---|---|
| ***H01R 43/24*** | (2006.01) |
| ***H01R 13/405*** | (2006.01) |
| ***H01R 13/516*** | (2006.01) |
| ***H01R 24/30*** | (2011.01) |
| ***H01R 13/504*** | (2006.01) |

(52) U.S. Cl.

CPC ..... *H01R 13/516* (2013.01); *H01R 13/504* (2013.01); *H01R 24/30* (2013.01); *H01R 13/405* (2013.01)

(58) Field of Classification Search

CPC ..... H01R 43/24; H01R 13/405

See application file for complete search history.

(56) References Cited

U.S. PATENT DOCUMENTS

| | | | | |
|---|---|---|---|---|
| 3,755,615 | A * | 8/1973 | Paullus | H01R 13/5205 174/76 |
| 5,664,964 | A * | 9/1997 | Crofoot | H01R 43/24 439/495 |
| 7,909,635 | B2 * | 3/2011 | Hughes | H01R 13/53 174/84 R |
| 8,100,725 | B2 | 1/2012 | Su et al. | |
| 8,269,829 | B2 * | 9/2012 | Miller | G02B 23/2476 348/65 |
| 8,317,531 | B2 * | 11/2012 | Kleinke | H01R 9/03 439/275 |
| 8,931,167 | B2 * | 1/2015 | Abughazaleh | H05K 3/325 29/842 |
| 2009/0068891 | A1 * | 3/2009 | Osenberg | H01R 9/032 439/607.41 |
| 2009/0215299 | A1 * | 8/2009 | Hughes | H01R 13/46 439/278 |
| 2012/0184128 | A1 * | 7/2012 | Nachbauer | H01R 13/5205 439/460 |
| 2014/0073185 | A1 | 3/2014 | Siahaan et al. | |

* cited by examiner

*Primary Examiner* — Gary Paumen

(74) *Attorney, Agent, or Firm* — Ming Chieh Chang; Wei Te Chung

(57) ABSTRACT

A cable connector assembly and method of assembling the same. The cable connector assembly includes a cable connector and a cable connected to the cable connector. The cable connector includes an insulative body, a plurality of terminals held in the insulative body, an internal member molded in the cable connector, and a plastic housing disposed outside of the internal member. The internal member includes a through hole penetrating obliquely the internal member. The through hole includes a first opening proximal to the cable and a second opening distal from the cable. Adhesive is filled the through hole from the first opening through the second opening to contact with an inner surface of the plastic housing.

17 Claims, 5 Drawing Sheets

CABLE CONNECTOR ASSEMBLY INSTALLED CONVENIENTLY AND METHOD OF ASSEMBLING THE SAME

BACKGROUND OF THE INVENTION

1. Field of the Invention

The present invention relates to a cable connector assembly, and more particularly to a fixing structure of plastic housing of the cable connector assembly, as well as to a manufacturing method of such cable connector assembly.

2. Description of Related Arts

U.S. Pat. No. 8,100,725, issued on Jan. 24, 2012, discloses a cable connector assembly including an insulative body, a number of terminals, a spacer assembled to the insulative body, a cable electrically connecting to the terminals, a metal shell enclosing the insulative body for EMI protection, and a plastic case surrounding the metal shell and a front portion of the cable. Since the plastic case is molded to enclose the metal shell, stability of the insulative body is low.

An improved cable connector assembly is desired to offer advantages over the related art.

SUMMARY OF THE INVENTION

An object of the present invention is to provide a cable connector assembly having a securely mounted outer plastic housing.

To achieve the above-mentioned object, a cable connector assembly and method of assembling the same. The cable connector assembly includes a cable connector and a cable connected to the cable connector. The cable connector includes an insulative body, a plurality of terminals held in the insulative body, an internal member molded in the cable connector, and a plastic housing disposed outside of the internal member. The internal member includes a through hole penetrating obliquely the internal member. The through hole includes a first opening proximal to the cable and a second opening distal from the cable. Adhesive is filled the through hole from the first opening through the second opening to contact with an inner surface of the plastic housing.

According to the present invention, the through hole is filled by adhesive from the first opening The adhesive provides sufficient holding force to fix the plastic housing. Excessive adhesive is received in the receiving slot to prevent it from flowing out of the plastic housing.

DETAILED DESCRIPTION OF THE PREFERRED EMBODIMENT

Figure 1:
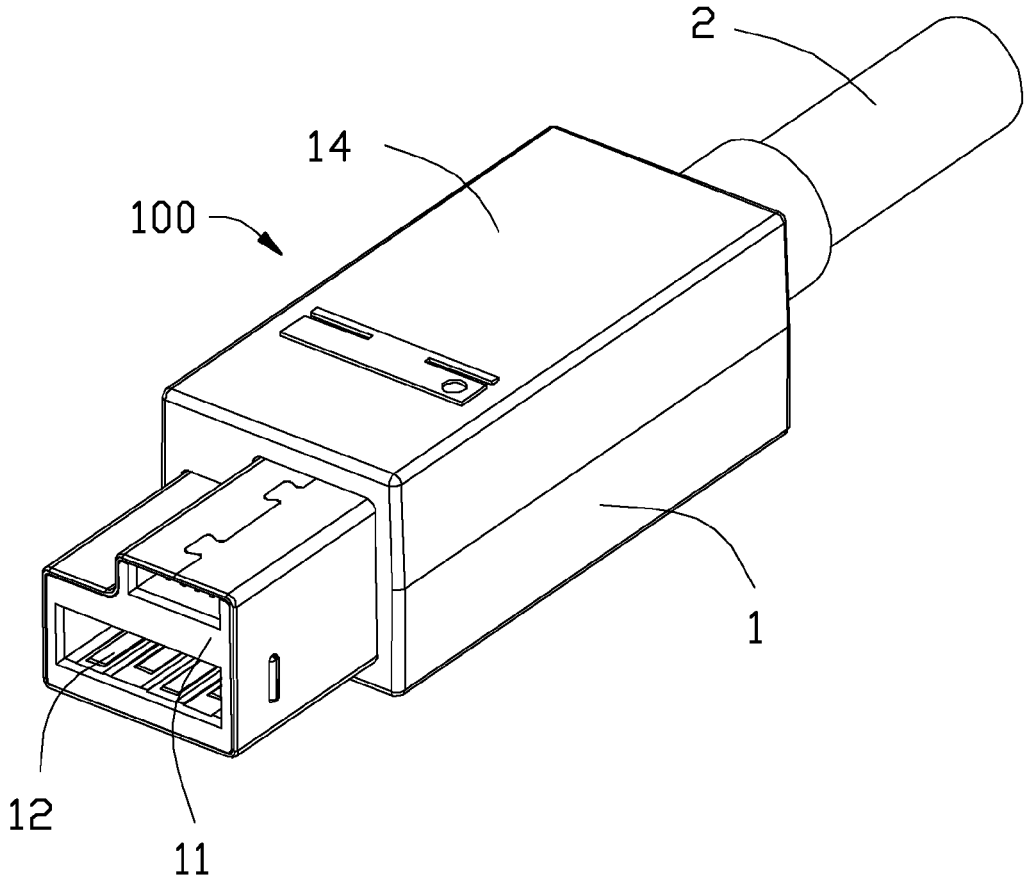
FIG. 1 is a perspective view of a cable connector assembly in accordance with the present invention.

Reference will now be made in detail to some preferred embodiments of the present invention.

Referring to FIGS. 1 to 4, a cable connector assembly 100 comprises a cable connector 1 and a cable 2 connected to the cable connector 1. The cable connector 1 comprises an insulative body 11, a plurality of terminals 12 held in the insulative body 11, an internal member 13 molded in the cable connector 1 and the cable 2, a plastic housing 14 disposed out of the internal member 13, and a metal shell 15 disposed in the plastic housing 14.

Figure 5:
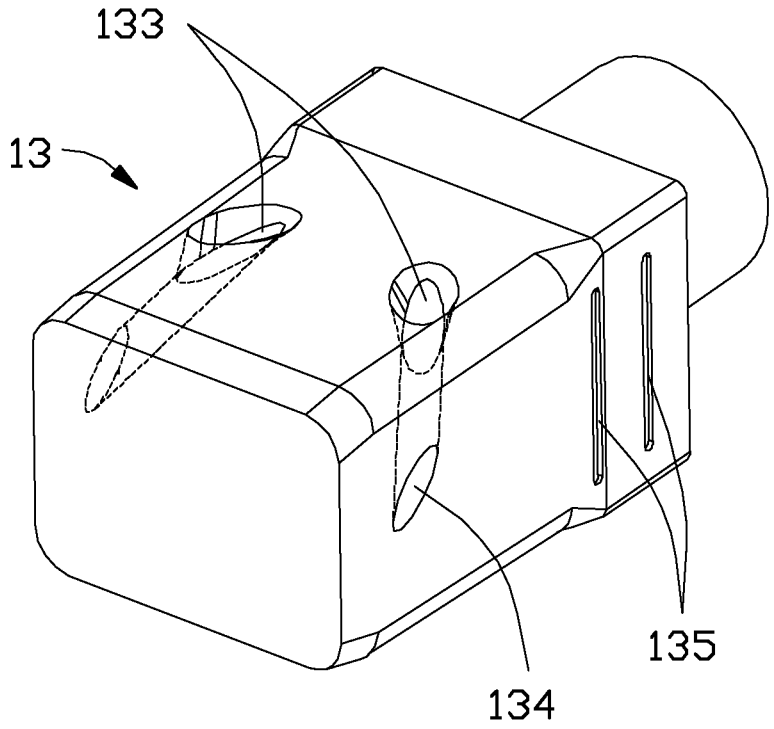
FIG. 5 is a perspective view of the through hole of the internal member as shown in FIG. 1.

Referring to FIG. 5, the internal member 13 comprises a main portion 130 and an annular portion 131 set on the cable 2. The main portion 130 comprises a through hole 132 penetrating obliquely the internal member 13. The through hole 132 forms a first opening 133 proximal to the cable 2 and a second opening 134 distal from the cable 2 on the internal member 13. When the plastic housing 14 is mounted to cover the second opening 134 but not the first opening 133, the adhesive is filled in the through hole 132 from the first opening 133. The adhesive contacts with an inter surface of the plastic housing 14 through the second opening 134. After the adhesive solidifies, the plastic housing 14 is fixed with the internal member 13 firmly. The main portion 130 comprises a plurality of receiving slots 135 recessing inwardly from an outer surface of the main portion 130. After the plastic housing 14 encloses the internal member 13, the receiving slot 135 receives excessive adhesive to prevent the adhesive from flowing out of the plastic housing 14 to influence the appearance of the cable connector assembly 100.

The main portion 130 comprises an upper face 135, an opposite lower face (not shown), and a pair of side faces 137 connecting the upper face 136 and the lower face. The second opening 134 and the receiving slot 135 are disposed on the same face of the main portion 130. In this embodiment, the first opening 133 is disposed on the upper face 136 of the main portion 130, and the second opening 134 is disposed on the side face 137 of the main portion 130. A size of the first opening 133 is larger than the size of the second opening 134. The larger size of the first opening 133 is convenient to fill the adhesive form the first opening 133. In this embodiment, the adhesive is glue.

The metal shell 15 comprises a hook 151. An end of the hook 151 proximal to the cable 2 is perking. After the plastic housing 14 is mounted to the metal shell 15, the hook 151 can prevent the plastic housing 14 from retreating before the adhesive is solidified. The hook 151 interferes with the plastic housing 14 to increase the stability of the plastic housing 14.

Figure 2:
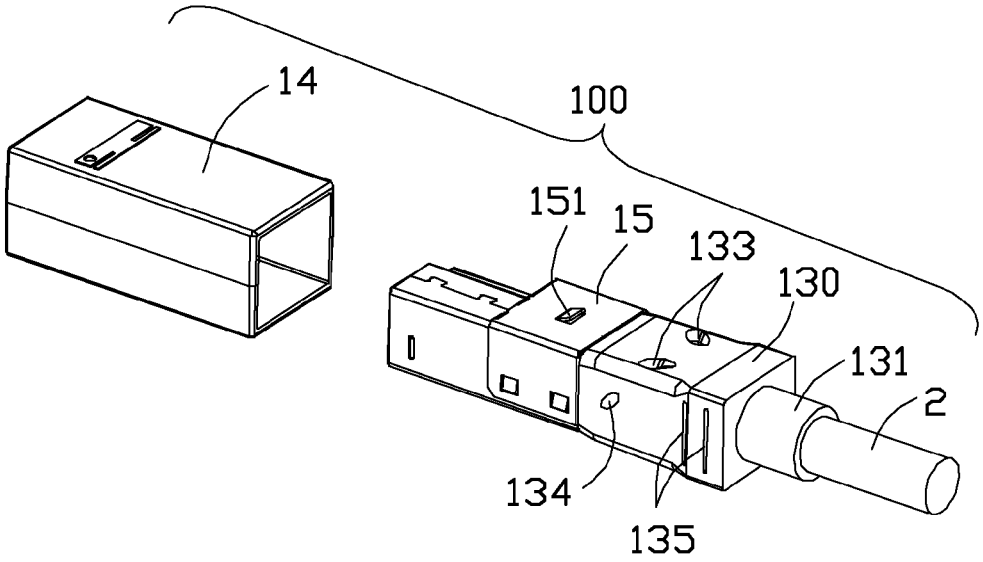
FIG. 2 is a schematic diagram of the plastic housing of the cable connector assembly located on a first position as shown in FIG. 1.
Figure 3:
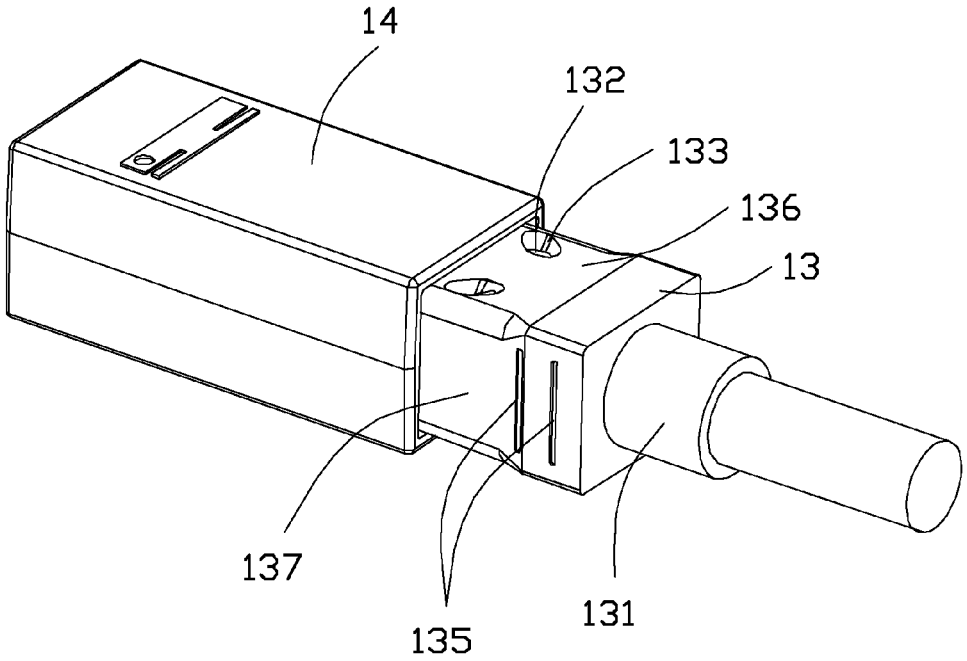
FIG. 3 is the schematic diagram of the plastic housing of the cable connector assembly moving on a second position as shown in FIG. 2.
Figure 4:
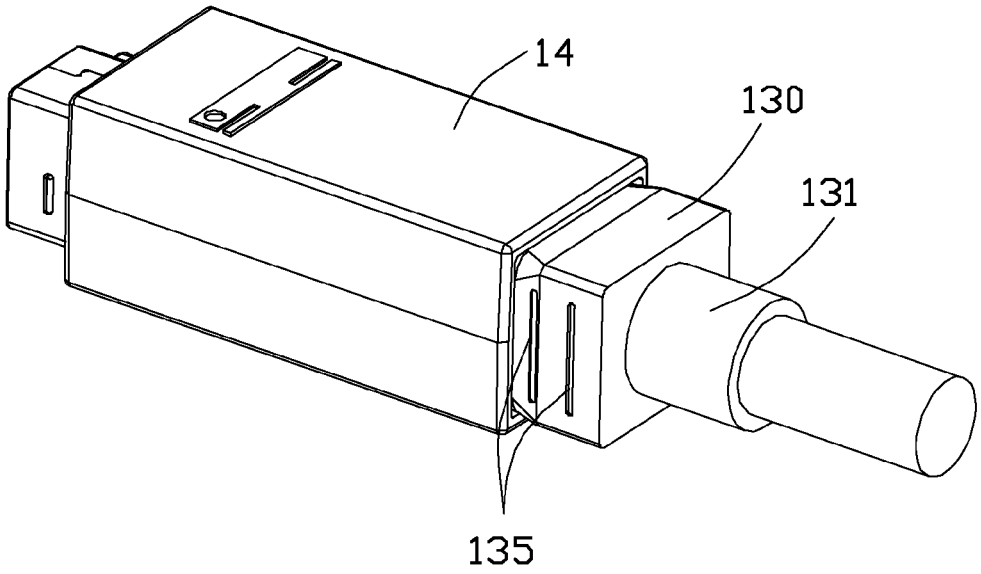
FIG. 4 is the schematic diagram of the plastic housing of the cable connector assembly moving on a third position as shown in FIG. 3.

A method of manufacturing a plug connector assembly 100 comprises the steps as follows. The terminals 12 are disposed in the insulative body 11 firstly. Solder the cable 2 to the terminals 12 secondly. The metal shell 15 encloses the insulative body 11 thirdly. The mold the internal member 13 on a front end of the cable 2. Referring to FIG. 2, the plastic housing 14 is on the first position before mounting. The plastic housing 14 is then moved to cover the internal member 13 along a direction of the cable 2. Referring to FIG. 3, the plastic housing 14 is on the second position. Fill in adhesive from the first opening 133 when the plastic housing 14 has already covered the second opening 134 but not covered the first opening 133. The adhesive contacts with an inter surface of the plastic housing 14 through the second opening 134. Referring to FIG. 4, the plastic housing 14 is then moved to the third position. Excessive adhesive is received in the receiving slot 135. Then move the plastic housing 14 to cover the whole main portion 130 of the internal member 13.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a cable connector comprising an insulative body, a plurality of terminals held in the insulative body, an internal member molded in the cable connector, and a plastic housing disposed outside of the internal member; and a cable connected to the cable connector; wherein the internal member comprises a through hole penetrating obliquely the internal member, the through hole including a first opening proximal to the cable and a second opening distal from the cable; and adhesive fills in the through hole from the first opening through the second opening to contact with an inner surface of the plastic housing.

2. The cable connector assembly as recited in claim 1, wherein the internal member comprises a receiving slot recessing inwardly for receiving excessive adhesive during mounting the plastic housing.

3. The cable connector assembly as recited in claim 2, wherein the internal member comprises an upper face, an opposite lower face, and a pair of side faces connecting the upper face and the lower face, the second opening and the receiving slot disposed on the same face of the internal member.

4. The cable connector assembly as recited in claim 3, wherein the first opening is disposed on the upper face of the internal member, and the second opening is disposed on the side face of the internal member.

5. The cable connector assembly as recited in claim 4, wherein a size of the first opening is larger than a size of the second opening.

6. The cable connector assembly as recited in claim 1, further comprising a metal shell disposed in the plastic housing, the metal shell comprising a hook interfering with the plastic housing to stabilize the plastic housing.

7. A method for manufacturing a cable connector assembly, comprising the steps of:

providing an insulative body;

disposing a plurality of terminals into the insulative body;

connecting a cable behind the terminals;

molding an internal member on a front end of the cable, the internal member comprising a through hole extending along not only an axial direction but also a transverse direction, the through hole defining a first opening proximal to the cable and a second opening distal from the cable;

mounting a plastic housing to cover the second opening but not the first opening of the internal member along the axial direction toward the cable and filling adhesive into the through hole from the first opening to contact with an inner surface of the plastic housing through the second opening; and moving the plastic housing to wholly cover the internal member.

8. The method as recited in claim 7, wherein the step of molding comprises forming a receiving slot and the step of moving comprises guiding excessive adhesive into the receiving slot.

9. The method as recited in claim 7, further comprising a step of disposing a metal shell in the plastic housing, the metal shell comprising a hook interfering with the plastic housing to stabilize the plastic housing.

10. The method as recited in claim 7, wherein said through hole extends in a straight manner along an oblique direction angled to said axial direction.

11. The method as recited in claim 7, wherein said second opening is lower than the first opening.

12. A cable connector assembly comprising:

a cable connector comprising an insulative body, a plurality of terminals held in the insulative body, a metallic shell enclosing said housing, an internal member molded over metallic shell, and a plastic housing surrounding the internal member; and a cable connected to and behind the cable connector; wherein the internal member comprises a through hole penetrating the internal member, the through hole including opposite first opening and second openings; wherein adhesive is filled into the through hole from the first opening toward the second opening to contact with an inner surface of the plastic housing around said second opening; wherein said first opening is located behind the second opening in a front-to-back direction.

13. The cable connector assembly as claimed in claim 12, wherein said internal member and said housing are configured to have the housing rearwardly assembled unto the internal member along said front-to-back direction.

14. The cable connector assembly as claimed in claim 12, wherein the first hole is located at a first face of said internal member different from a second face of said internal member where the second opening is located.

15. The cable connector assembly as claimed in claim 12, wherein said through hole extends in a straight manner.

16. The cable connector assembly as claimed in claim 15, wherein said through hole extends oblique relative to the front-to-back direction.

17. The cable connector assembly as claimed in claim 12, wherein said second opening is lower than the first opening during filling the adhesive.

* * * * *